US005167470A

United States Patent [19]

Bertolozzi et al.

[11] Patent Number: 5,167,470

[45] Date of Patent: Dec. 1, 1992

[54] FUEL COLLECTION PAN FOR GASOLINE DISPENSER

[75] Inventors: Rano J. Bertolozzi, Des Plaines; Theodore Cortapassi, Dolton; Edward E. Reicin, Skokie, all of Ill.

[73] Assignee: MPC Containment Systems, Ltd., Chicago, Ill.

[21] Appl. No.: 557,202

[22] Filed: Jul. 24, 1990

[51] Int. Cl.[5] ..... B65B 3/06

[52] U.S. Cl. ..... 405/52; 137/312; 141/86

[58] Field of Search ..... 405/52, 53; 137/312, 137/363; 141/86; 220/18; 222/108

[56] References Cited

U.S. PATENT DOCUMENTS 4,659,251 4/1987 Petter et al. ..... 405/52
4,762,440 8/1988 Argandona ..... 405/52
4,802,792 2/1989 Flessas ..... 405/53
4,896,705 1/1990 Podgers et al. ..... 141/86
4,921,115 5/1990 Fields ..... 220/18
4,971,477 11/1990 Webb et al. ..... 405/52 X

*Primary Examiner*—David H. Corbin
*Attorney, Agent, or Firm*—Laff, Whitesel, Conte & Saret

[57] ABSTRACT

A dispenser pan for collecting fluids spilled under a gasoline dispenser (pump). The pan may be installed without necessarily requiring a removal of the dispenser from its underlying supporting structure. The pan is made of a flexible membrane which may be stuffed through a hole in a cement island supporting the dispenser, worked into position, and then anchored in place. A pocket is formed on the bottom of the membrane in order to form a sump and in order to receive a shear valve on the bottom of the sump.

24 Claims, 2 Drawing Sheets

FUEL COLLECTION PAN FOR GASOLINE DISPENSER

This invention relates to pump liners or dispenser pans for collecting gasoline and other fluids under dispensers (pumps) in gasoline service stations.

The pump box liners or drainage pans described herein are engineered for durability, ease of installation and efficient fuel containment. (The terms "pump liner" and "drainage pan" are used interchangeably hereinafter.) Over a long life time, the flexible, high-technology material used to make these items is virtually indestructible under dispenser site conditions. It is unaffected by substantially all fuels and additives and will not crack or corrode like rigid fiberglass or steel containment boxes which have been used heretofore. In addition, the flexibility of the material makes it easy to install the necessary product piping, vapor-recovery piping, conduit, and drainage to secondary containment. That is, a pipe may be somewhat out of alignment and the inventive liner or pan may be coerced far enough to make a reliable connection to it. The liner also connects easily to single-wall pipe systems.

These pans may be parts of secondary containment systems or the like such as those shown in U.S. Pat. Nos. 4,682,911; 4,778,310; and 4,818,151. Attached FIG. 6 and FIG. 13 of these patents show a metal pan under a dispenser (pump) in a gasoline filling station, by way of example. The pan covers an opening in the cement beneath the dispenser, and at the same time, extends beneath a shear valve, filter, and any other device below the dispenser. The service station operator has to have access to a shut off mechanism on the shear valve in order to service a filter on the dispenser. If any gasoline is spilled at the dispenser, it is caught in the pan, and either evaporated or drained into the secondary containment system if enough gasoline is collected.

One problem with this prior art dispenser pan is that it is a rigid structure which is usually installed while the dispenser is removed from its supporting structure, such as a cement island. It would be most difficult if not impossible to install it while the dispenser is in place. Also, if it was installed before the cement was poured, it may be necessary to remove the cement forming the island in order to remove or replace a defective pan.

To minimize the cost of these pans, it should be possible to install them without requiring any construction work to be performed at the island where the dispenser is located. It should also be possible to install the pan without requiring the removal of the dispenser from its base on the island. This is especially desirable in stations having intricate canopies immediately above the dispenser which tend to prevent the dispenser from being removed.

On the other hand, it is also desirable to provide pump liners or drainage pans which are suitable for new construction. This kind of a product is installed before the cement is poured to make the island. Here, a primary concern is to enable the installer to make suitable connections between the liner or pan and the pipes which were not installed with such precision that they are necessarily aligned with mating couplers on the liner or pan.

Accordingly, an object of this invention is to provide new and improved secondary containment systems. Here, an object is to collect gasoline spilled from a dispenser in a gasoline service station.

In keeping with an aspect of the invention, a flexible membrane is used as a pan which may be installed without requiring a removal of the dispenser. The membrane may be stuffed through an access hole or open area under the dispenser or pump. Then, the membrane is spread under a shear valve, filter or other structure in this area. The membrane is clamped or clipped into place to prevent a service station operator from trying to simply lift out the flexible pan, thereby spilling any gasoline which may have been collected therein. The membrane may be unclipped and removed; however, that is a deliberate act which is done by a person who will thereby be reminded to remove the spillage from the pan.

In keeping with a further aspect of the invention, the membrane (a "deep pump box liner") may be constructed to fit the inside of the mounting box for the dispenser. Suitable sleeves are welded to the membrane in order to provide coupling to misaligned pipes.

A preferred embodiment of the invention is shown in the attached drawings, wherein:

FIG. 2B shows a method of sealing a membrane at a point where it is penetrated by a pipe or the like;

Figure 4:
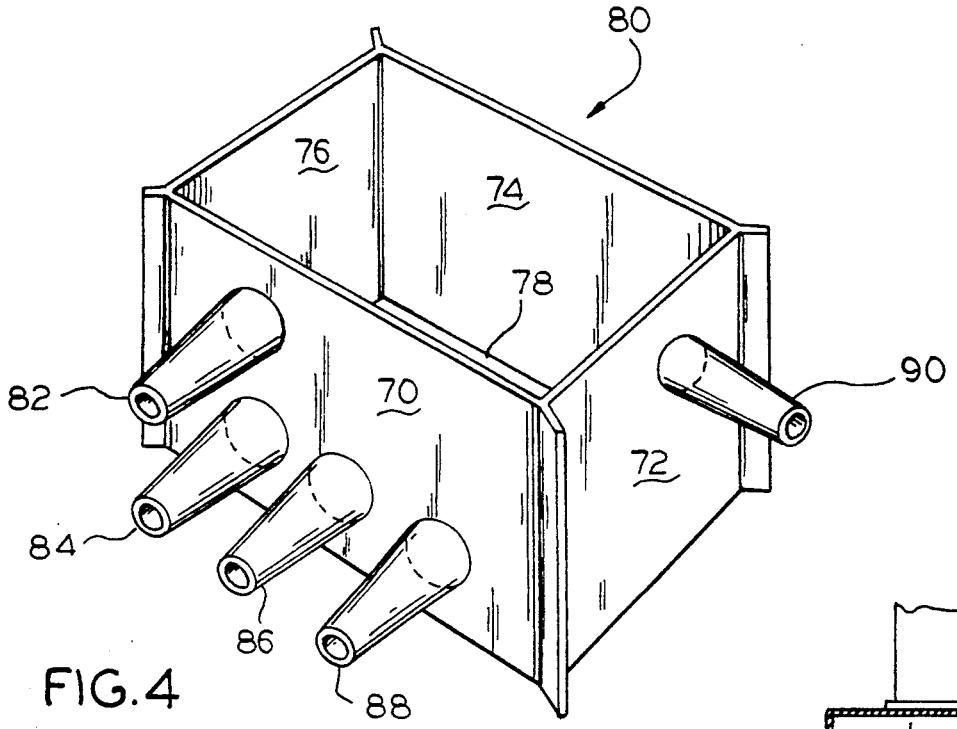
FIG. 4 is a perspective view of an embodiment of a deep pump box liner or drainage pan having sleeves for making connections to pipes, even mis-aligned pipes.
Figure 6:
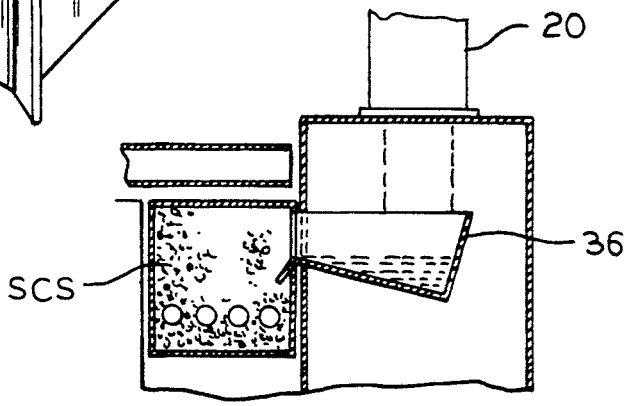
Figure 5:
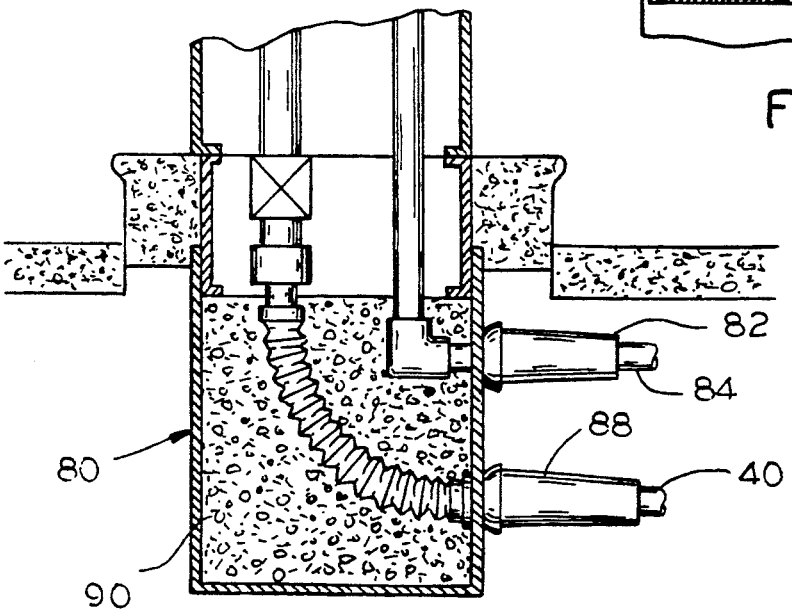

FIG. 5 is a cross section view which illustrates how to install the pump liner or drainage pan of FIG. 4; and FIG. 6 shows drainage into a secondary containment system and it taken from U.S. Pat. No. 4,818,151.

The dispenser 20 is here shown as having a lower angle iron frame 21 resting on and anchored to an island 22 which may be the same as island 46 in the above identified of U.S. Patents, for example. The island 22 may be made of concrete and surrounded by asphalt 24 in most service stations. Normally, the island is formed with a hole 26 or open area which is covered by the base of the dispenser 20. This hole 26 provides means for giving the dispenser access to suitable fuel delivery hoses 28, conduits 29 for electric wiring, data telemetering cables, vapor recovery or the like.

In addition to the purely access functions, the hole or open area 26 also provides room for certain essential equipment associated with the dispenser, such as shear valves 30, replaceable filter elements, meters, and the like, all of which are known to those who are skilled in the art. A mounting box 32 embedded in the concrete of island 22 provides a device for anchoring the dispenser 20. The problem is to collect and contain the gasoline or other fluid which may, for any reason, spill through hole 26. The spillage could be from the shear valves, from the filter, or perhaps from carelessness. Regardless of why it is caused, means 34 should be provided to capture the spillage before it can penetrate the earth. Also, to reduce the cost of installation or replacement it should be possible for the spillage collection and capture means 34 to be installed beneath the dispenser 20, while it is still in place.

The inventive spillage collection and capture means 34 is a dispenser pan that meets all of these requirements. The pan is made of a flexible membrane, preferably one of the materials shown and described in the above identified U.S. Patents. This membrane has physical properties which resist the attack of hydrocarbons so that it may be used as a pan for collecting and capturing gasoline which is spilled at the dispenser and into the hole 26. It may be stuffed into the hole 26 and then spread to extend below the shear valves 30; therefore, it can be installed without removing the dispenser 20 from the island 22.

The pan is a sheet of membrane material with a sump means in the form of a pocket 36 that extends down below the shear valve 30. It might be noted that this embodiment has a shape which somewhat suggests an inverted hat with a crown 36 and a brim 42. On the bottom of the pocket 36, there are openings that enable the product piping 40 and other connections to penetrate the bottom of the dispenser pan for supplying product to the dispenser. This dispenser pan penetration is designed so that it can be connected to either a secondary containment systems SCS as disclosed in the above identified patents, one example of which is shown in FIG. 6; or, by the use of an adapter such as sleeve 90 (FIG. 4), for example, it may be connected to a standard 1 ½" or 2" pipe.

The installation procedure is very simple. The product line piping 40 and any other conduits, such as 29, to the dispenser are disconnected. The shear valve 30 is removed. Then, the dispenser pan is installed through the opening 26 in the island 22. The shear valve and the piping 40 are then re-installed. The pan is then attached and anchored in one of two ways. If the dispenser 20 can be removed, the membrane is spread and the dispenser is then re-installed on top of the dispenser mounting box 32 with the membrane 34 clamped therebetween. If the dispenser was not removed, clips are inserted beneath the dispenser and are connected to fasteners which are emplaced in the membrane forming the dispenser pan. These clips prevent an operator or mechanic from lifting the pan and inadvertently dumping fuel which has been collected in the pan onto the ground.

Figure 3:
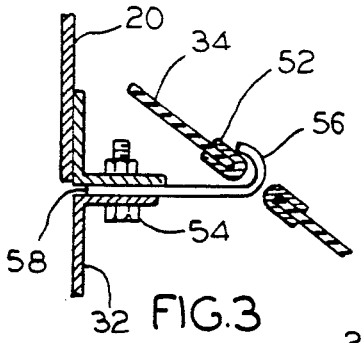
FIG. 3 is a fragment of FIG. 2A showing an optional clip for anchoring the flexible membrane forming the dispenser pan.

FIG. 3 illustrates one way of providing the clips which may be used to anchor the membrane when the dispenser cannot be removed from the island 22. More particularly, it may be recalled that, if the dispenser can be removed, the flexible membrane is spread over the hole 26 and clamped between the bottom frame 21 of dispenser 20 and the anchor box 32 when the dispenser is again bolted into place. When the dispenser cannot be removed, the clips are necessary.

A plurality of grommets 52 (FIG. 3) are fastened in the perimeter region of the membrane and at locations corresponding to the positions of bolts 54, which anchor the dispenser. A piece of metal or wire 56 is constructed to clip-on and securely hook into the grommet. The nut 60 may be loosened on the dispenser anchor bolt 54 to provide a little play so that the dispenser may be rocked slightly, even though it is not removed from its supporting island 22. When it is so rocked, a hook or tail 58 on clip 56 may be securely hooked around the bolt 54 in the area between angle iron frame 21 and box 32 In the alternative embodiment, the tail 58 may be a wire which is worked under the angle iron frame 21 and wrapped around the shank of bolt 54. In still another embodiment, the tail 58 may have a hole which fits over bolt 54 after the nut 60 is removed. Then, the nut 60 is tightened on bolt 54 to secure the clip 56.

Figure 2B:
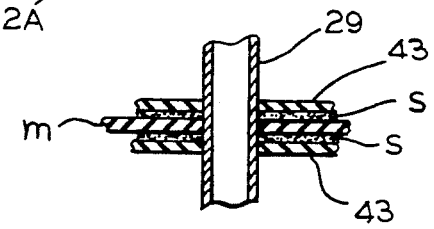

A sealant is applied around each opening in the membrane forming the pan (FIG. 2B). Plates (such as 43) are preferably bolted securely in place on opposite sides of the membrane M at locations where conduits must penetrate the membrane. The sealants may be placed between the plates and membranes. For example, a sealant may be applied at the location where the conduit 29 and location 44 where the shear valve control penetrate the membrane.

A preferably 3.5-inch fiberglass pipe is attached to the bottom of the pocket 36 by any suitable means such as hose clamp 48. Such a pipe may be connected into almost all known secondary containment systems. The pipe 46 may also be connected to any of many known fuel removal means, such as pumps, drains, or the like.

Figure 1:
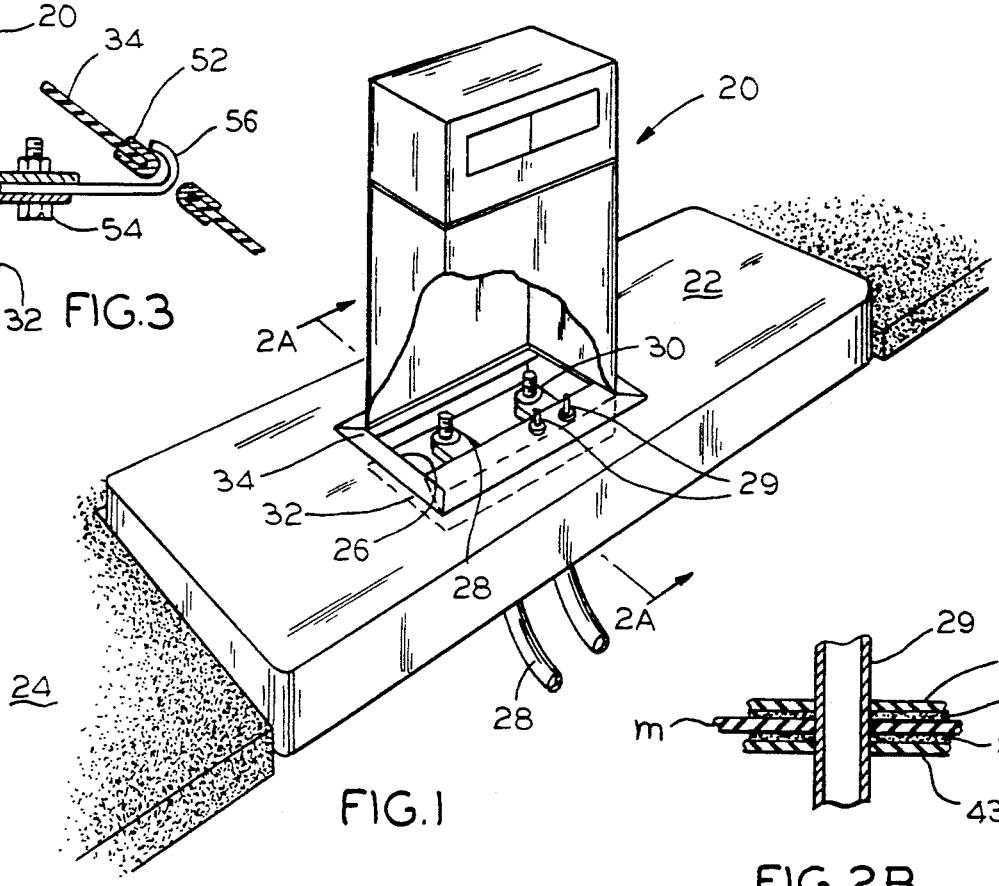
FIG. 1 is a simplified perspective view of a gasoline dispenser which is shown to illustrate a use of the invention dispenser pan.
Figure 2A:
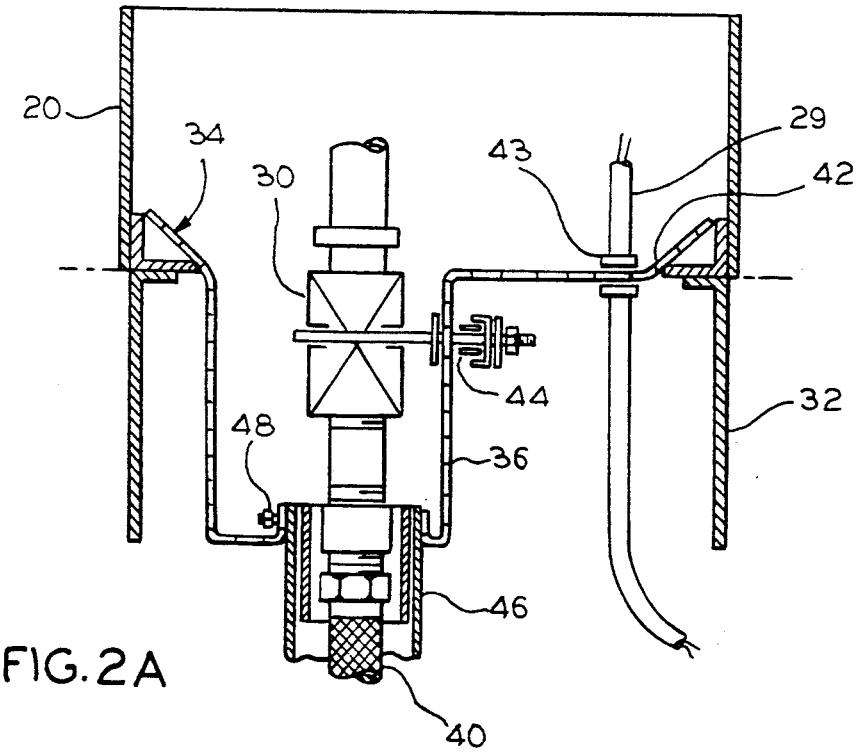
FIG. 2A is a cross section of the dispenser pan taken along line 2—2 of FIG. 1.

FIGS. 1-3 relate primarily to old construction where the inventive pump liner or drainage pan is installed under existing pumps, with or without removing them. FIGS. 4, 5 relate primarily to new construction where the pump liner or drainage pan is installed before the cement island is formed. Of course, it is possible for either embodiment to be used under conditions where one would naturally think of using the other.

In FIG. 4, a plurality of membrane panels 70-76 and a bottom panel 78 are cut to size and heat welded together in order to form a deep pump box liner 80 which fairly accurately fits inside the pump mounting box 32. Welded to at least some of the panels 70, 72 are a plurality of sleeves 82-90 which receive suitable pipes, conduits, and the like.

These sleeves may be joined to the entrance pipes and conduits by any suitable means, such as sealants and pipe clamps. For example, FIG. 5 shows the product line 40 joined to sleeve 88 for delivering product to the pump. The conduit 84 is joined to sleeve 82 for any other convenient purpose. For example, conduit 84 may provide entry for electrical power lines, exit for vapor recovery, or the like.

When the installation is part of new construction, it is customary to fill the box 80 with any suitable ballast 90, such as pea gravel. The top of the box 80 may be anchored in place by any suitable means.

Those who are skilled in the art will readily perceive how to modify the invention. Therefore, the appended claims are to be construed to cover all equivalent structures which fall within the true scope and spirit of the invention.

We claim:

1. A liquid collection pan for installation under a gasoline dispenser housing, on an island which has at least one hole formed therein for giving an entrance for a fuel delivery line and at least one electrical conduit, said hole being of a size and shape which is covered by the bottom of a gasoline dispenser supported on said island, said collection pan comprising a flexible and supple membrane made of material having physical properties which resist the attack of hydrocarbons, said flexibility being sufficient to enable said supple membrane to be stuffed through said dispenser housing and being sufficient to enable said membrane to be spread in said hole under said dispenser housing, said membrane having a periphery shaped and dimensioned to be connected to the bottom of said dispenser, and sump means at a low point on said pan for capturing liquids in a location which facilitates its removal from said pan.

2. The collection pan of claim 1 and means associated with said membrane for preventing an inadvertent dumping of fuel by simply lifting said membrane forming said pan while it contains a liquid.

3. The collection pan of claim 2 wherein said gasoline dispenser has associated fastener means for securing it to an island, said means for preventing a dumping of fuel comprises separate clip means secured to said fastener means while they remain in place for securing said dispenser to said island, and means associated with the perimeter of said membrane for attaching it to said clip means, whereby said membrane is secured in place without removing said dispenser.

4. The collection pan of claim 1 wherein said dispenser has a shear valve below the bottom thereof, said sump means enabling said membrane to fit below said shear valve.

5. The collection pan of claim 4 and a pair of isolation plates sealed onto opposite sides of said membrane by a sealant in at least some locations where the membrane forming said pan is penetrated.

6. The collection pan of claim 4 and a drainage pipe associated with said pump means for emptying said pan.

7. The collection pan of claim 6 wherein said drainage pipe passes through an opening in said membrane, and a pipe clamp means for attaching the membrane surrounding said opening to said pipe.

8. The collection pan of claim 1 wherein said membrane is shaped somewhat in the form of an inverted hat, and is flexible enough to be stuffed into position with said gasoline dispenser in place.

9. A liquid collection pan for installation under a gasoline dispenser housing, on an island which has at least one hole formed therein for giving an entrance for a fuel delivery line and at least one electrical conduit, said hole being of a size and shape which is covered by the bottom of a gasoline dispenser supported on said island, said collection pan comprising a flexible membrane made of material having physical properties which resist the attack of hydrocarbons, said collection pan comprising a flexible and supple membrane made of material having physical properties which resist the attack of hydrocarbons, said flexibility being sufficient to enable said supple membrane to be stuffed through relatively small openings, said membrane being formed into a deep pump box liner for installation in new construction, said membrane having a periphery shaped and dimensioned to be connected to the bottom of said dispenser housing, and pump means at a low point on said pan for capturing liquids in a location which facilitates its removal from said pan.

10. The collection pan of claim 9 and at least one sleeve welded thereto in order to give a conduit access into the interior of said deep pump box.

11. In a gasoline dispensing system wherein an island has at least one hole formed therein for giving an entrance for a fuel delivery line and at least one electrical conduit, said hole being of a size and shape which is covered by the bottom of a gasoline dispenser housing having a shear valve associated therewith, a combination comprising fuel spillage collecting pan which may be installed while said dispenser is in place, said pan comprising a flexible and supple gasoline resistant membrane having a perimeter which is approximately equal to the size and shape of the bottom of said dispenser housing so that said membrane covers the hole and completely encompasses the area at the bottom of said dispenser housing, said flexible membrane being flexible and supple enough to drape downwardly and form a sump below the shear valve, whereby said flexible and supple membrane may be installed by passing it through said dispenser housing and into said hole in said island and under said shear valve without removing said dispenser from said island, means for sealing said conduit to said membrane at a location where it penetrates the membrane, and means for securing the perimeter of said membrane to the bottom of said dispenser housing thereby forming a fluid collecting bottom surface for said dispenser housing.

12. The fuel spillage collecting pan of claim 11 wherein there is a secondary containment system for said gasoline dispensing system, and means in said sump for draining said pan into said containment system.

13. The fuel spillage collecting pan of claim 11 and means in said sump for draining said collected fluids from said pan.

14. The fuel spillage collecting pan of claim 11 and draining means includes a pipe, and a pipe clamp means for attaching said membrane to said pipe.

15. The fuel spillage collecting pan of claim 11 wherein anchor bolts are associated with the bottom of said gasoline dispenser housing for securing it to said island, said combination further comprising clip means associated to said bolt means, and means associated with the perimeter of said membrane for attaching it to said clip means.

16. The flexible membrane of claim 14 wherein at least one of said means for sealing is a pipe attached to said membrane by a pipe clamp.

17. The flexible membrane of claim 15 and means for preventing an inadvertent dumping of said pan by simply lifting said membrane.

18. In a gasoline dispensing system wherein an island has at least one hole formed therein for giving an entrance for a fuel delivery line and at least one electrical conduit, said hole being of a size and shape which is covered by the bottom of a gasoline dispenser having a shear valve associated therewith, a combination comprising fuel spillage collecting pan which may be installed while said dispenser is in place, said pan comprising a flexible gasoline resistant membrane having a perimeter which is approximately equal to the size and shape of the bottom of said dispenser so that said membrane covers the hole, said flexible membrane being flexible enough to drape downwardly and be formed into a sump below the shear valve, whereby said flexible membrane may be installed by passing it through said hole and under said shear valve without removing said dispenser from said island, means for sealing said conduit to said membrane at a location where it penetrates to said dispenser thereby forming a fluid collecting bottom surface for said dispenser, said securing means having a tail with one end which hooks around an anchor bolt in a space between a bottom of said gasoline dispenser and said island, clip-on means on another end of said tail, and fastener means associated with said perimeter which engages said clip-on means.

19. In a gasoline dispensing system wherein an island has at least one hole formed therein for giving an entrance for a fuel delivery line and at least one electrical conduit, said hole being of a size and shape which is covered by the bottom of a gasoline dispenser having a shear valve associated therewith, a combination comprising fuel spillage collecting pan which may be installed while said dispenser is in place, said pan comprising a flexible gasoline resistant membrane having a perimeter which is approximately equal to the size and shape of the bottom of said dispenser so that said membrane covers the hole, said flexible membrane being flexible enough to drape downwardly and to be formed into a sump below the shear valve, whereby said flexible membrane may be installed by passing it through said hole and under said shear valve without removing said dispenser form said island, means for sealing said conduit to said membrane at a location where it penetrates the membrane, means for securing the perimeter of said membrane to said dispenser thereby forming a fluid collecting bottom surface for said dispenser, said securing means having a wire, one end of said wire hooking around an anchor bolt for securing a bottom of said gasoline dispenser to said island, clip-on means on another end of said wire, and attaching means associated with said perimeter for engaging said hook means.

20. In a gasoline dispensing system wherein an island has at least one hole formed therein for giving an entrance for a fuel delivery line and at least one electrical conduit, said hole being of a size and shape which is covered by the bottom of a gasoline dispenser having a shear valve associated therewith, a combination comprising fuel spillage collecting pan which may be installed while said dispenser is in place, said pan comprising a flexible gasoline resistant membrane having a perimeter which is approximately equal to the size and shape of the bottom of said dispenser so that said membrane covers the hole, said flexible membrane being flexible enough to drape downwardly and to be formed a sump below the shear valve, whereby said flexible membrane may be installed by passing it through said hole and under said shear valve without removing said dispenser from said island, means for sealing said conduit to said membrane at a location where it penetrates the membrane, means for securing the perimeter of said membrane to said dispenser thereby forming a fluid collecting bottom surface for said dispenser, said securing means having a tail with one end which hooks over an anchor bolt in a space between a bottom of said gasoline dispenser and said island, clip-on means on another end of said tail, and fastener means associated with said perimeter for engaging said clip-on means.

21. A flexible and supple membrane made of a material which resists an attack from hydrocarbons, said membrane being flexible and supple enough to mount in an open cavity area under a gasoline dispenser housing without a removal of said dispenser from its operating location and further having a perimeter of a size and shape which attached to the bottom of a gasoline dispenser housing, said cavity under said dispenser housing providing access for enabling connections between said dispenser and sources of gasoline and electrical energy, said membrane being flexible enough to drape under gravity downwardly into said cavity for forming said membrane into a sump for collecting fluids from said dispenser, means for draining said collected fluids from said membrane sump, openings in said membrane for enabling service pipes and conduits to penetrate said membrane in order to make connections to said sources, and means at each of said openings in said membrane for sealing said membrane to each of said pipes and conduits.

22. The flexible member of claim 21 wherein at least one of said sealing means comprises a pair of plates and a sealant on opposite sides of said membrane.

23. The collection pan of claim 21 wherein said gasoline dispenser housing has associated bolt means for securing it to an island, means for preventing a dumping of fuel comprising separate clip-on means for attaching said membrane to said bolt means while they remain in place securing said dispenser to said island, and means associated with the perimeter of said membrane for attaching it to said clip-on means, whereby said membrane is secured in place without removing said dispenser.

24. The flexible membrane of claim 21 wherein said sealing means is a sleeve welded to said membrane.

* * * * *